US005875991A

United States Patent [19]

Branchut

[11] Patent Number: 5,875,991

[45] Date of Patent: Mar. 2, 1999

[54] DEVICE FOR WINDING UP OR UNWINDING ELONGATED FLEXIBLE ARTICLES

[76] Inventor: Jean Pierre Branchut, 34 bis, avenue de la Liberation, F-17220 Croix-Chapeau, France

[21] Appl. No.: 817,115

[22] PCT Filed: Oct. 5, 1995

[86] PCT No.: PCT/NO95/00180

§ 371 Date: Apr. 7, 1997

§ 102(e) Date: Apr. 7, 1997

[87] PCT Pub. No.: WO96/11160

PCT Pub. Date: Apr. 18, 1996

[30] Foreign Application Priority Data

Oct. 6, 1994 [NO] Norway ..... 943751

[51] Int. Cl.[6] ..... B65H 19/00

[52] U.S. Cl. ..... 242/559.4; 242/399.1; 242/596.5

[58] Field of Search ..... 242/559.4, 399.1, 242/596.5

[56] References Cited

U.S. PATENT DOCUMENTS

| | | | |
|---|---|---|---|
| 1,742,029 | 12/1929 | Fallot | 242/559.4 |
| 1,799,984 | 4/1931 | Larmuth | 242/559.4 X |
| 1,818,720 | 8/1931 | Lamatsch | 242/559.4 |
| 1,874,904 | 8/1932 | Crafts | 242/559.4 |
| 2,912,180 | 11/1959 | Lindberg | 242/559.4 X |
| 2,915,257 | 12/1959 | Bruns . | |
| 3,038,680 | 6/1962 | Rose . | |
| 3,394,897 | 7/1968 | Martin, Sr. | 242/559.4 X |
| 3,955,770 | 5/1976 | Offermann | 242/596.5 X |
| 4,030,704 | 6/1977 | Beierle et al. . | |
| 4,098,468 | 7/1978 | Skalleberg . | |
| 4,165,052 | 8/1979 | Seibert . | |
| 4,265,411 | 5/1981 | Fasolak | 242/559.4 |
| 4,284,249 | 8/1981 | Legallasi et al. | 242/559.4 X |
| 4,973,008 | 11/1990 | Focke et al. | 242/559.4 X |
| 5,121,885 | 6/1992 | Chipman | 242/533 X |
| 5,288,031 | 2/1994 | Linderoth . | |
| 5,316,231 | 5/1994 | Thievessen et al. | 242/559.4 |
| 5,607,120 | 3/1997 | Folsom | 242/559.4 |

FOREIGN PATENT DOCUMENTS 2 046 207 11/1980 United Kingdom .

*Primary Examiner*—Donald P. Walsh
*Assistant Examiner*—William A. Rivera
*Attorney, Agent, or Firm*—Young & Thompson

[57] ABSTRACT

A device for winding up or unwinding elongated flexible articles comprising two bearings (1) forming a winch, supported on a substantially horizontal surface (7), and means (17) for moving all the bearings (1) towards and away from one another perpendicular to the unwinding direction so that the bearing (1) may be brought to bearing relationship with a drum (9) thereby enabling a rotation of said drum, and means (14, 16) adapted to be moved to supporting contact with a drum (9) and for lifting and lowering said drum relative said bearings. The supporting contact means comprise slings (14) connected to said lifting and lowering means (16).

2 Claims, 3 Drawing Sheets

DEVICE FOR WINDING UP OR UNWINDING ELONGATED FLEXIBLE ARTICLES

Figure 1:
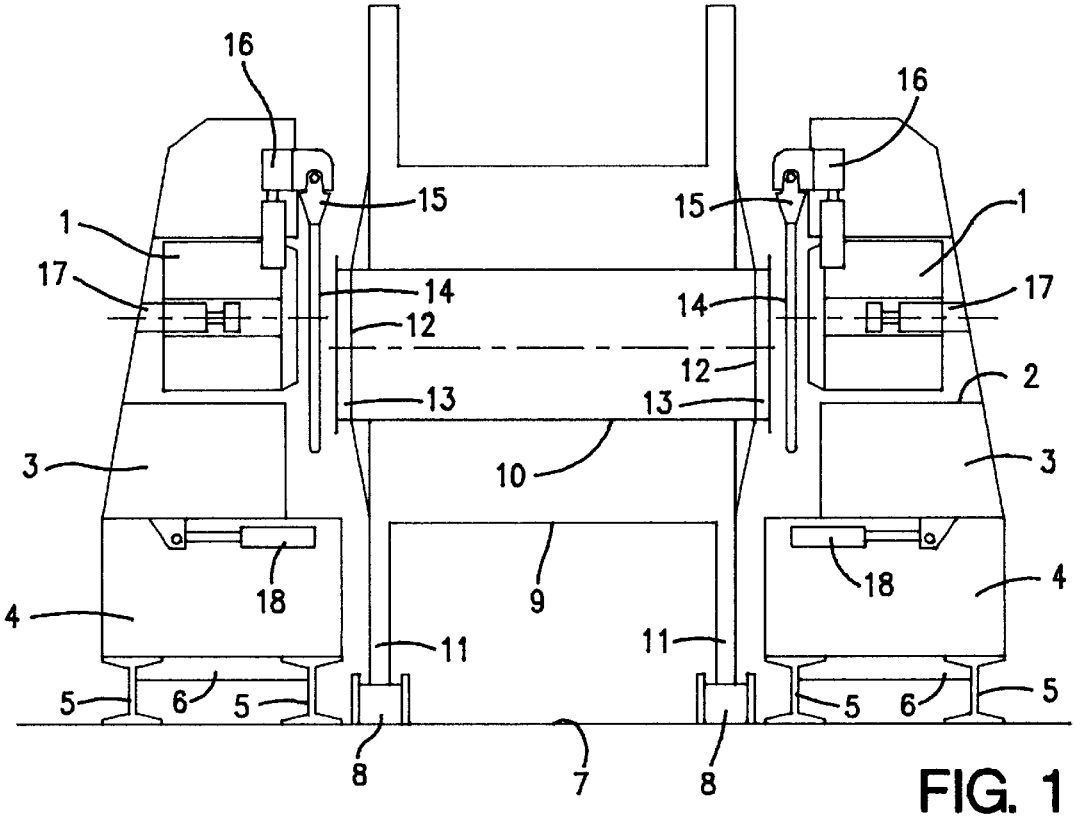

The present invention relates to a device for winding up or unwinding flexible elongated articles, such as pipes or cables.

Devices of this type are, for example, installed on ships for laying submarine pipes or cables. They essentially comprise a winch on which can be arranged a drum onto which is wound the cable or pipe.

In such cases the loaded drum represents a heavy item and during the sea voyage from port to the laying area the drum needs to be secured to the ship's deck, thus isolating the bearings from the drum load. This is also the case during the return to port with the empty drum.

There is often a considerable distance between the place of laying the cable or tube and the port where full drums are stored. It is therefore important to be able to use the ship drum storage capacity to the full. It is therefore known to arrange a plurality of drums on a ship's deck using a device of the said type to engage and carry each drum in succession, thereby enabling the unwinding of the cable or pipe carried by the drum.

The transfer of the drum load from the deck to the device and vice versa represents a critical phase of the drum handling operation, especially at sea.

In a known winch device (GB 2046207-B) this critical transfer is solved in that two bearings are moved vertically in a frame until they are located in the extension of the axis of the drum, whereafter the bearings are moved towards each other so that the bearings engage the sides of the drum. The drum is then lifted by means of the bearings which are raised vertically in the frame.

Another solution of the problem known from coil handling apparatus (see e.g. U.S. Pat. No. 2,915,257) is of course to have bearings held stationary in the vertical direction and lift the drum to a raised position where the drum axis is aligned with the bearing, or to lower or break away the drum deck support after the bearings are moved towards each other and brought to engage the sides of the drum in question. The first of these alternative solutions calls for specific securing means for the drum during lifting at sea whereas the latter solutions call for costly power actuated support means for each of the stored drums or envolves the use of deck personnel in a hazardous work area.

The facility to move the bearings both vertically and horizontally—as in GB 2046307-B—to and from the respective drum sides, requires a complex structure, the complexity of which, has a negative influence on the restraining means of the bearings.

It is therefore an object of the invention to provide a device for winding up or unwinding elongated flexible elements, such as pipes or cables, wherein the bearings are held stationary in the vertical direction, means being provided for lifting and lowering a drum relative the bearings in a secure manner.

Thus there is according to the invention forwarded the proposal for the use of a pair of wire rope slings which may be brought to a at least to partly envelope the lifting boss of the drum and moved vertically by suitable displacing means, to and from a position wherein the drum axis is aligned with the bearings.

The use of slings will ensure that the drum is held and supported in a secure manner during the critical handling phase between deck and bearings and vice versa. The use of slings also makes it possbile to handle a number of drums of different sling contact diameters within limits set by the sling length.

Preferable embodiments of the invention are set out in the claims.

The invention is described in greater detail hereinafter relative to a non-limitative embodiment and the attached drawings wherein show:

FIGS. 1–5 show a front view of a device according to the invention in different drum handling stages.

As shown in the drawings, the device has in general manner two bearings 1 each mounted horizontally sliding in a horizontal guide 2 in a frame 3. Each frame 3 is mounted so as to slide in the direction of arrows (FIG. 2) on a carriage 4. Each of the carriages 4 is installed so as to move on two rails 5 perpendicular to the sliding direction of the carriage 4. Guiding and locking means 6 are provided to guide and immobilize carriage 4 on rails 5. The rails 5 are fixed to the deck 7 of a ship. Supporting means 8 for a drum 9 are also fixed to the deck 7, between the two pair of rails 5.

The drum 9 is shown schematically without a cable or tube wound thereon and comprises a hollow drum boss 10 and drum flanges 11. The boss 10 has ends 12 adapted to engage a respective bearing 1 and comprising a circumferential groove 13 adapted to receive a sling 14. Each sling 14 forms an upwardly open curve, the sling ends 15 being connected to a lifting and raising means 16, respectively.

Each bearing 1 may slide in the horizontal guide 2, this sliding being brought about by a jack 17.

The frames 3 may be brought to slide on the carriages 4 by a jack 18.

Each carriage 4 may be displaced by means of skidding units (not disclosed). Guiding and locking means 6 immobilize carriage 4 on rails 5.

The device described hereinafter is used as follows.

A drum 9 is arranged on the deck 7 of a ship between the two pairs of rails 5 with the drum axis perpendicular to the axes of the rails. The drum carries a certain lenght of flexible cable or tube (not shown). By means of skidding units (not shown) the two carriages are displaced on rails 5 until the bearing 1 are located with their axes in the same vertical plane as the drum axis. The guiding and locking means 6 are then activated to immobilize carriages 4 on rails 5. This stage is shown in FIG. 1.

Figure 2:
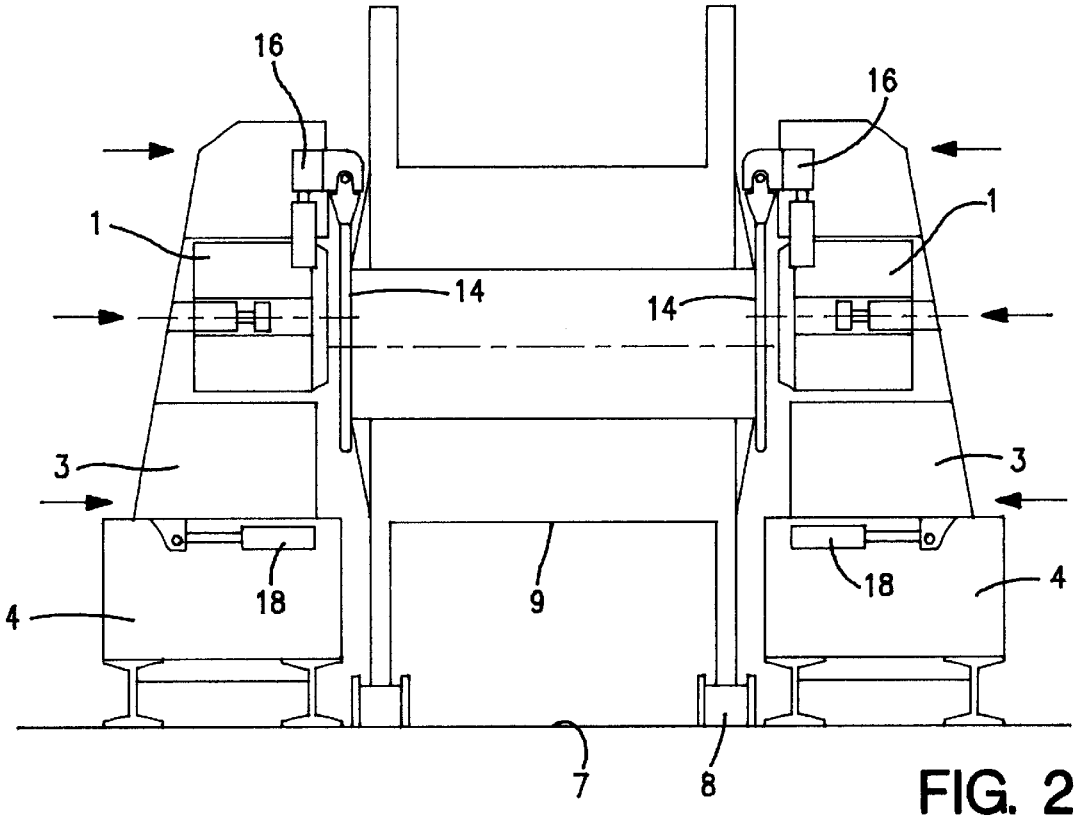

Jacks 18 are then operated in order to move together frames 3 and consequently the slings 14 on the one hand and the grooves 13 on the sides of the drum on the other until the slings 14 align vertically with the grooves 13. This stage is shown in FIG. 2.

Figure 3:
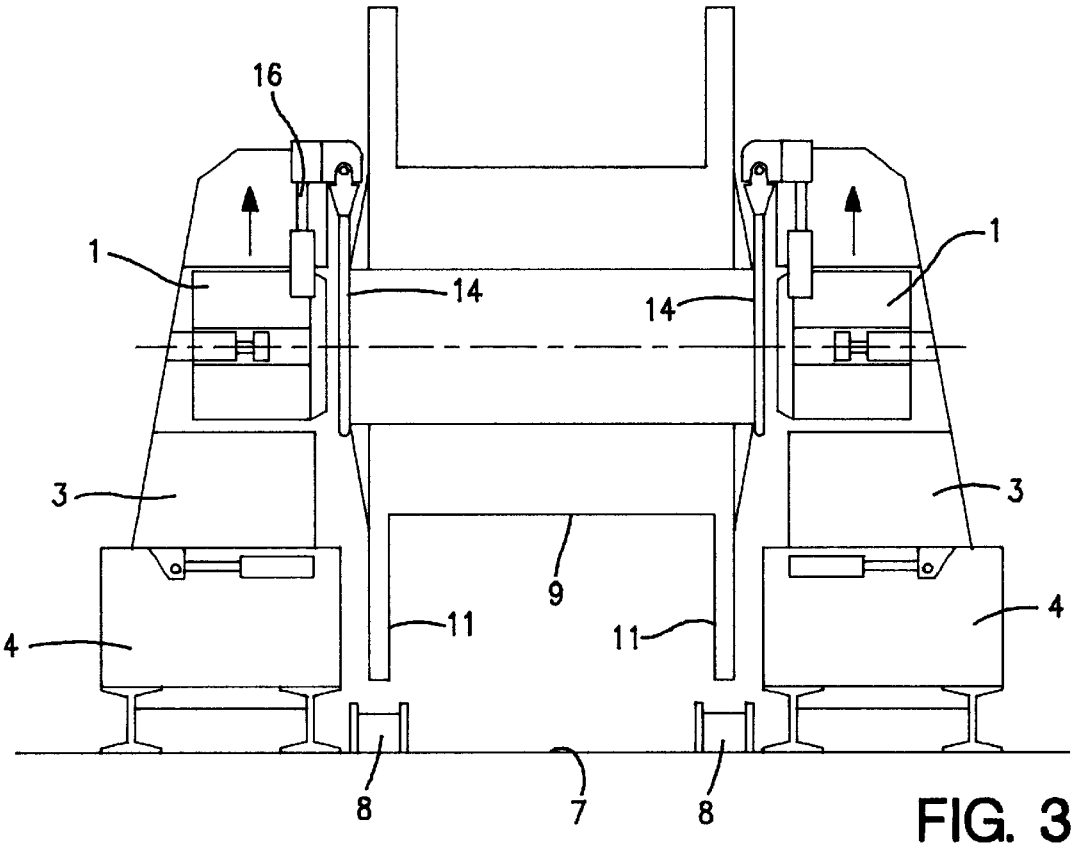

By actuating jacks 16 the slings 14 are displaced vertically upwards so that they enter the grooves 13 and by further upwards displacement will lift the drum 9, as shown in FIG. 3, to a position wherein the drum axis aligns with the bearings 1.

The jacks 17 are now activated, thereby moving the bearings 1 towards each other and into engagement with the drum ends 12. This stage is disclosed in FIG. 4. The jacks 16 are activated to free the slings 14 from groove contact. The jacks 16 may be activated in a sense enabling the slings 14 to act as braking bands, if need be.

The cable or tube may now be unwound.

Figure 4:
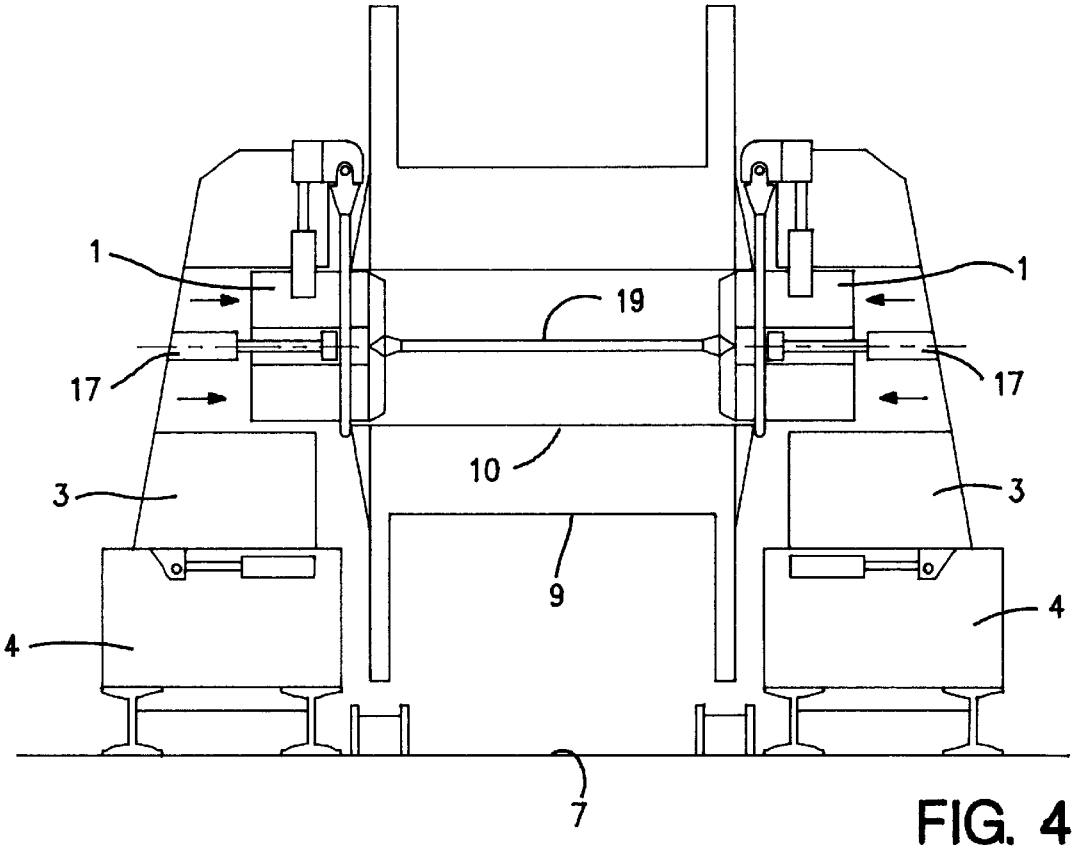
Figure 5:
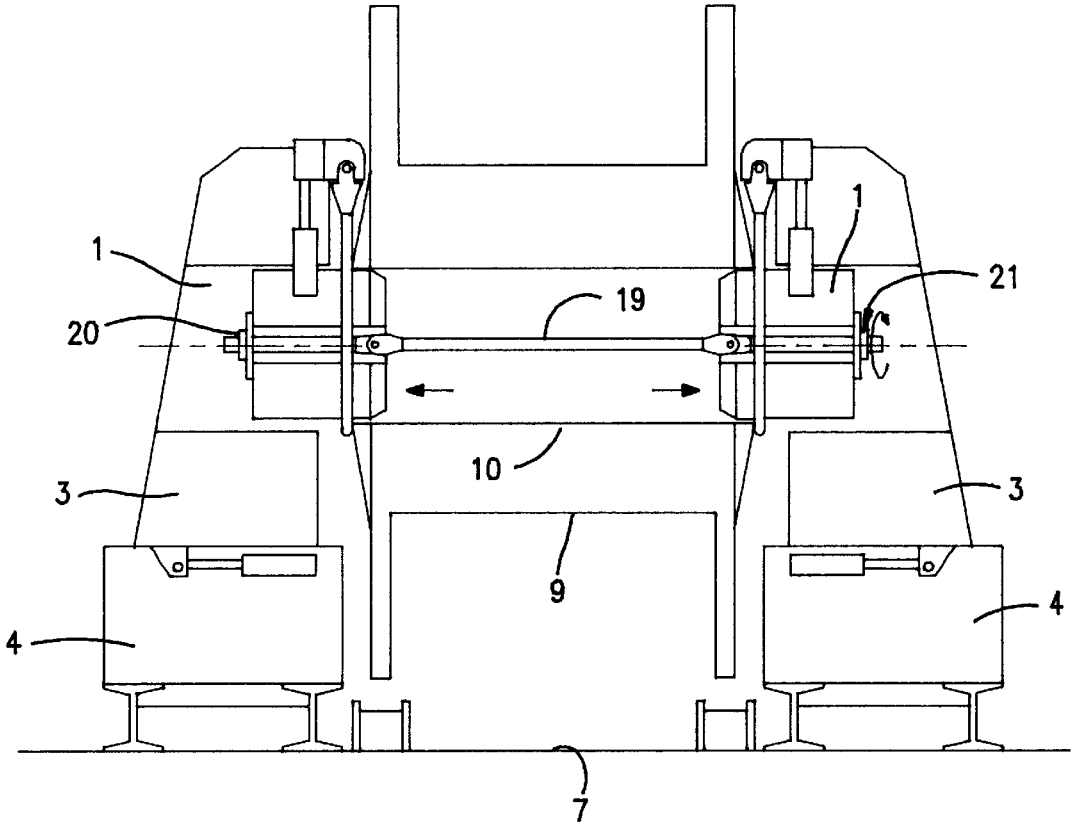

Preferably the device comprises connecting means 19 between the bearings 1 through the hollow drum boss 10, as shown in FIGS. 4 and 5. This arrangement is of particular interest when the device is installed onboard a ship. During an inclination of the device due to the pitch or roll of the ship the tilting torque applied by the drum to one of the bearings will be taken up by the other bearing, which brings about a better balancing of the loads. The connecting means 19 is anchored in one of the bearings 1 at 20 and may be manipulated (tightened) by a screw spindle and nut arrangement 21 in the other bearing 1 (FIG. 5).

As known a number of drums may be provided on the deck 7, in one or more rows, all drums in one row being served by one device according to the invention.

It is obvious that the device according to the invention allows for a sturdy bearing structure and safe vertically displacing of the drum in a cost effective manner.

The slings as disclosed are wire ropes. Other slings, for example chain slings, are of course possible.

I claim:

1. A shipboard device for rotating a drum with a circumferentially extending groove on each drum end and which carries a wound member, comprising:

two pairs of rails for being fixed to a deck of a ship and for carrying the device;

two carriages movable on said rails, each of said carriages being independently supported and carried by a different pair of said two pairs of rails;

means for guiding and selectively immobilizing each of said carriages on a respective pair of said rails;

two frames, each of said frames being mounted on a different one of said carriages and being movable relative to said carriages in a first direction perpendicular to a direction of said rails;

two bearings, each of said bearing being mounted on a different one of said frames, said bearings being aligned axially by relative movement of said two carriages and spaced apart to form a winch for carrying the drum between said two bearings;

means for moving said two bearings axially relative to said frames and in said first direction so that each of said two bearings can be brought into a bearing relation with an adjacent drum end to enable rotation of the drum; and two carrying slings, each of said slings being carried by a different one of said frames above said bearings for lifting and lowering the drum relative to said two bearings, each of said two slings being constructed and arranged to be brought into and out of supporting contact with the circumferential groove at an adjacent drum end;

one set of one of each of said carriages, frames, bearings and slings being spaced apart from and not connected to the other set of one of each of said carriages, frames, bearings and slings to permit unobstructed passage of the drum between said two sets.

2. The device of claim 1, further comprising two jacks, each carried by a respective one of said two frames above said bearings, each of said two jacks for lifting and lowering a respective one of said two slings.

* * * * *